United States Patent [19]

Nishino

[11] Patent Number: 4,966,026

[45] Date of Patent: Oct. 30, 1990

[54] EDGING ROLL FOR USE IN MAKING SECTIONS HAVING FLANGES

[75] Inventor: Taneharu Nishino, Sakai, Japan

[73] Assignee: Nippon Steel Corporation, Tokyo, Japan

[21] Appl. No.: 243,309

[22] PCT Filed: Dec. 24, 1987

[86] PCT No.: PCT/JP87/01024

§ 371 Date: Aug. 18, 1988

§ 102(e) Date: Aug. 18, 1988

[87] PCT Pub. No.: WO88/04965

PCT Pub. Date: Jul. 14, 1988

[30] Foreign Application Priority Data

Dec. 29, 1986 [JP] Japan ..... 61-315648

[51] Int. Cl.[5] ..... B21B 1/08

[52] U.S. Cl. ..... 72/224; 72/366.2; 74/397; 74/399

[58] Field of Search ..... 72/224, 225, 366; 74/397, 398, 399, 570, 571 M, 571 R; 29/125

[56] References Cited

FOREIGN PATENT DOCUMENTS 3514464 1/1986 Fed. Rep. of Germany ..... 72/224
48-32917 10/1973 Japan .
54-110955 8/1979 Japan .
58-53317 3/1983 Japan ..... 72/224
59-97702 6/1984 Japan ..... 72/224
61-7003 1/1986 Japan .
61-137609 6/1986 Japan .
62-77107 4/1987 Japan .
63-60008 3/1988 Japan .

*Primary Examiner*—Lowell A. Larson
*Assistant Examiner*—Thomas C. Schoeffler
*Attorney, Agent, or Firm*—Cushman, Darby & Cushman

[57] ABSTRACT

This invention relates to an edging roll for rolling the flange edges (12*a*) of a rolling material (12), specifically to an edging roll which is adaptable commonly to rolled sections having different dimensions and is capable to roll the flange edges with the web portion of the rolling material guided. The web guide roll (10) is ring-shaped and rotatable along the outer periphery of the outer eccentric sleeve (6). When rolling material is changed according to a schedule in rolling mill operation, the inner eccentric sleeve (5) is rotated along the outer periphery of the flange roll (8) and set there, the outer eccentric sleeve (6) is rotated along the outer periphery of the inner eccentric sleeve (5) and set there. And the flange roll (8) is set at a position of rolling the flange edges, and the web guide roll (10) is at a position of restraining and guiding the web portion.

4 Claims, 8 Drawing Sheets

EDGING ROLL FOR USE IN MAKING SECTIONS HAVING FLANGES

TECHNICAL FIELD

This invention relates to an edging roll for use in making shaped steel having flanges such as H-sections or others.

BACKGROUND ART

The universal rolling method is generally used in rolling shaped steel having flanges such as H-sections (hereinafter abbreviated as H-sections or others). FIG. 9 shows views of an example of the universal rolling method. Rolling stand (1) represents a breakdown stand which rolls a bloom of cross-section (1-1) into a beam blank of (1-2). Rolling stand (2) indicates a universal rolling stand, in which the beam blank (1-2) is reduced the web thickness by a pair of upper and lower horizontal rolls (2*a*) and reduced the flange thickness simultaneously by a pair of vertical rolls (2*b*) and by the horizontal rolls (2*a*). This universal rolling is repeated several times. (2-1) denotes cross-section of the rolling material in early pass, and (2-2) denotes cross-section of the rolling material after several passes of the universal rolling.

Rolling stand (3) indicates an edging stand. The edging stand (3) is arranged adjacent to the universal rolling stand (2). In the edging stand (3), a pair of upper and lower edging rolls (3*a*) roll the flange edges of the rolling material so that the edges of the flanges are forged, and the dimension of the flanges is adjusted. The edge rolling is repeated several times between universal rolling passes, e.g. alternately.

That is, rolling material (2-1) is edge rolled into (3-1), and in case of rolling material (2-2), widening the gap of the upper and lower edging rolls (3*a*), (2-2) is edge rolled into (3-2).

But, in this edging rolls (3*a*), when the rolling material (3-2), for example, is edged, a clearance (S) occurs between edging roll (3*a*) and its corresponding part of the web portion of 3-2). Because of this clearance (S), the amount of reduction by the edge rolling is unstable, and since (3-2) may sway right and left, the edging roll cannot guide the section (3-2) correctly. These have resulted in wrong dimensions and shapes of H-sections or others. In FIG. 9, rolling stand (4) represents a universal finishing stand, in which a pair of upper and lower horizontal rolls (4*a*), and a pair of right and left vertical rolls (4*b*) finish the shape and dimensions of the section (3-2) into a product (4-2).

FIGS. 10A to FIG. 10B2 are adverse examples which take place in the conventional edge rolling method. FIG. 10A shows an example in which there is a clearance between the edging roll and its corresponding part of the web portion of a rolling material, and a rolling material is deformed. FIG. 10B1 shows an example in which only the upper roll contacts its corresponding part of the web portion, pushing down the web portion. When the web portion is pushed down, as shown in FIG. 10B1, the rolling material results in the so-called web-off-centered H-section as shown in FIG. 10B2 after it is reformed. FIG. 10C shows an example in which the edging rolls are rolling the flange edges guiding with the web portion. The edging rolls of FIG. 10C are effective to prevent the web-off-center of the H-sections. But in this process, in case of changing the edge rolling operation from one section to another section, the edging rolls of a different lc is required. That is, in the rolling mill where many kinds of shaped steel having different flange widths and web thicknesses are rolled, and in the case of FIG. 10C, it is required to have always a large number of rolls having a variety of lc distances and to replace them frequently in accordance with lc of the rolling material. But this operation is very disturbing. Furthermore, in the edge rolling of FIG. 10C, the peripheral speed of the edging roll differs at the flange edges of a rolling material and at the web portion thereof. This causes scabby surfaces of the product and uneven abrasion of the roll.

Japanese Patent Laid-Open Publication No. 077107/1987 and Japanese Patent Laid-Open Publication No. 60008/1988 edging rolls which can be used commonly for a variety of rolling material having different flange widths and web thicknesses, and having a function to roll the flange edges guiding with the web portion. But in this art of using a single eccentric sleeve, as will be described below, the rolling position of the flange edges must be in advance or behind of the guiding position of the web portion. This makes it difficult to obtain a smooth edging operation, and causes upsweep or downsweep of the rolling material and inaccurate sectional dimensions of the product.

DISCLOSURE OF INVENTION

The object of the invention is to provide an edging roll, which is usable commonly for rolling material having different flange width and different web thickness, which can roll the flange edges guiding with the web portion, and which can restrain (guide) the web portion at the most relevant position for the edge rolling operation. FIG. 1 is a partial view showing the edging roll of this invention. That is, this invention relates to:

[I] an edging roll for use in making shaped steel having flanges, characterized in that flange rolls (8) each having a flange rolling portion (8*a*) and a sleeve mounting portion (8*b*) are disposed right and left on a main shaft (7) rotatably together therewith, an inner eccentric sleeve (5) is on the outer periphery of the sleeve mounting portion (8*b*) capable of rotating and setting at a required position thereon, an outer eccentric sleeve (6) is on the outer periphery of the inner eccentric sleeve (5) capable of rotating and setting at a required position thereon, and a web guide roll (10) is on the outer periphery of the outer eccentric sleeve (6) rotatably therealong;

[II] An edging roll according to [I], wherein the flange rolls (8) rotatably together with the main shaft (7) are slidable axially on the main shaft (7) and are capable of being set at a required position on the main shaft (7); and

[III] An edging roll according to [I] or [II], wherein an inner sleeve setting device (14) for setting the inner eccentric sleeve (5) at a required position of the sleeve mounting portion (8*b*), and an outer sleeve setting device (13) for setting the outer eccentric sleeve (6) at a required position of the inner eccentric sleeve (5), are sleeve setting devices having constant pressure mechanisms.

This invention will be explained in detail.

In FIG. 1, flange rolls (8) rotate together with main shafts (7) by means of, e.g., key members (9) to be given a rotating force from the main shafts (7). The flange edges (12*a*) of a rolling material (12) is rolled by the flange rolling portions (8*a*) of the flange rolls (8). The distance of the upper and the lower main shafts (7) is adjustable by a roll gap adjusting device (not shown), so that a suitable amount of reduction is capable to apply to the flange edges of the rolling material (12). The roll gap adjusting device may be a usual roll gap adjusting device.

The flange roll (8) is slidable axially on the main shaft (7) and is capable of being set. The interval between the right and the left rolls (8) is adjustable by a slide adjusting device (not shown) so as to be identical with the length of the web portion of the rolling material (12). The slide adjusting device may be known means, e.g., a hydraulic cylinder which slides the rolls by an oil pressure of a branch pipe provided in the main shaft (7), screw devices, or others.

Flange roll (8) has a sleeve mounting portion (8*b*). On the sleeve mounting portion (8*b*) are superposed an inner eccentric sleeve (5), an outer eccentric sleeve (6), and a web guide roll (10) in the mentioned order.

FIG. 2A to FIG. 2C are views showing cases where the inner eccentric sleeve (5) and the outer eccentric sleeve (6) are set at different positions after being rotated.

In FIG. 2A, the flange roll (8), which rotates together with the main shaft (7), is mounted on the main shaft (7). The inner eccentric sleeve (5) is on the outer periphery of the flange roll (8). The inner eccentric sleeve (5) does not rotate together with the flange roll (8) but is set at the required position during a edge rolling operation. On the outer periphery of the inner eccentric sleeve (5) is the outer eccentric sleeve (6). The outer eccentric sleeve (6) as well is set at the required position and does not rotate together with the flange roll (8) during the edge rolling operation. The web guide roll (10) is disposed on the outer periphery of the outer eccentric sleeve (6) rotatably thereto.

FIG. 3A is a sectional view of FIG. 2A along X—X. On the right and the left sides of the main shaft (7) are disposed the flange rolls (8) each having (5), (6), and (10).

As described above, the flange rolls (8) are slidable axially on the main shaft (7) so that the interval lw therebetween may be adjusted.

FIG. 4A is a sectional view of the rolling material (12-1), which has a wider flange width, being edge rolled with the inner eccentric sleeve (5) and the outer eccentric sleeve (6) set as in FIG. 2A and FIG. 3A. The flange edges of the rolling material (12-1) are rolled by the flange rolls (8) with the web portion restrained and guided by the web guide roll (10). During an edge rolling operation, the rolling material (12-1) is run by the rotating forces of the flange rolls (8), and the web guide roll (10) is rotated around the outer periphery of the outer eccentric sleeve (6) being restrained by the rolling material which is running.

When a rolling material (12-2) having a narrower flange width is rolled by this edging roll, the inner eccentric sleeve (5) is rotated around the flange roll (8) and set as shown in FIG. 2B, while the outer eccentric sleeve (6) is rotated around the inner eccentric sleeve (5) and set as shown in FIG. 2B. FIG. 3B is a sectional view of FIG. 2B along X—X. In rolling the rolling material (12-2) the upper main shaft (7) and the lower main shaft (7) are moved to the position shown in FIG. 4B by the roll gap adjusting device (not shown).

FIG. 4B is a view showing the edging roll which is edge rolling the rolling material (12-2). The rolling material (12-2) is restrained and guided at the web portion by the web guide rolls (10), and flange edges are rolled by the edging rolls (8).

FIG. 2C, FIG. 3C and FIG. 4C show further another example, where the inner eccentric sleeve (5) and the other eccentric sleeve (6) are set at further another position. A rolling material (12-3) having a minimum flange width is restrained and guided at the web portion and flange edges are rolled as explained with reference to FIGS. 2B, 3B and 4B.

As described above, this invention is capable to adjust (L-1) shown in FIG. 3A to a required distance. This invention is adaptable to rolling materials having various web thicknesses by adjusting the interval between the upper main shaft (7) and the lower main shaft (7).

This invention contains two sleeves, i.e., the inner eccentric sleeve (5) and the outer eccentric sleeve (6). The reason for using the two sleeves will be explained.

FIG. 5A and FIG. 5B show a reference example of the edging roll which contains a single eccentric sleeve (11). FIGS. 5C and 5D show this invention, which has the two eccentric sleeves.

FIG. 5A is a view showing the eccentric sleeve (11) set in the most eccentric position upward or downward. The flange rolls (8) roll the flange edges of a rolling material (12) from PA to QA. At this time the web guide roll (10) is restraining the web portion of the rolling material (12) at a point RA. The point RA is on the line interconnecting the axial centers of the upper and the lower flange rolls (8).

But, when a rolling material having a narrower flange width is edge rolled by the edging roll having a single eccentric sleeve, the eccentric sleeves (11) are set as shown in FIG. 5B. The flange rolls (8) roll the flange edges of the rolling material from PB to QB. The web guide roll (10) restrains the web portion of the rolling material at a point RB. But the point RB is by (m) off the line interconnecting the axial centers of the upper and the lower flange rolls (8). In edge rolling operation, the web portion is preferable to be restrained at or near the band interconnecting the upper rolling position (PB-QB) and the lower rolling position of the flange. But in FIG. 5B, the web guide roll (10) restrains the web portion at the point RB which is by (m) off the band interconnecting the upper and lower rolling position. In this case the rolling material is difficult to be guided securely, which results in inaccurate edge rolling, unstable pass of the rolling material, upsweep and downsweep of the rolling material.

In this invention, which has inner and outer eccentric sleeves, during an edging operation, the web can always be restrained by the web guide roll (10) at the point RC which is near the line interconnecting the axial centers of the upper and the lower flange rolls (8) as shown in FIG. 5C. And depending on a rolling operation, the web portion can be guided at another position, such as RD in FIG. 5D, by changing the setting position of the inner and the outer eccentric sleeves (5) and (6) respectively. Accordingly, in this invention, the web restraining position can be selected to be at the most suitable position relative to a rolling position of the flange edges. Thus, this invention enables any sections to be rolled having different flange widths to be restrained at the most suitable position thereof, and this results in good edge rolling operation of the rolling material.

The device for setting the inner and the outer eccentric sleeves (5) and (6) will be explained.

In FIG. 1, (13) represents an example of the device for setting the outer eccentric sleeves (6) at a required position. The device (13) comprises, for example, an arm (13-1) attached to the frame of the rolling mill, a hydraulic mechanism (13-2) disposed at the end of the arm (13-1), and a pushing rod (13-3) which is extensible right and left. The outer eccentric sleeves (6) are rotated to the required position, and then the pushing rod (13-3) which is located between the right and the left outer eccentric sleeves (6) is extended by the hydraulic mechanism (13-2). Then both the right and the left eccentric sleeves (6) are set at the required position.

In FIG. 1, (14) denotes a device for setting the inner eccentric sleeve (5) at a required position. The device (14) can set the right and the left inner eccentric sleeves (5) at a required position in the same way as the device (13).

By setting the inner and the outer eccentric sleeves (5), (6) at respective required positions the edge rolling can be carried out with the required width (L-1) in FIG. 3A kept constant.

Next, a sleeve setting device having constant pressure mechanism (hereinafter abbreviated as constant pressure type setting device) will be explained. In this invention, the web guide roll (10) does not reduce the web thickness of a rolling material but guides the web portion. For example, in cases where a gap between the web guide rolls (10) is narrower compared with a web thickness of a rolling material before passed or where the web thickness of a rolling material varies, an excessive load is applied to rolls and the stand housing. This results in damages of equipments, and cause waves on the web of the rolling material. It is desirable that when an excessive load acts to the web guide rolls (10), the gap between the upper and the lower web guide roll (10) is automatically increased.

Moreover, in case of the setting devices (13) and (14), the flange width (L-3) in FIG. 3A varies when (L-2) in FIG. 3A varies by uneven thickness of the web portion of the rolling material.

FIG. 6 is a view of an example of the constant pressure type setting device. (13-*a*) indicates a constant pressure type setting device for the outer eccentric sleeve (6). When a load larger than a prescribed load Po acts to the web guide rolls (10) in the edge rolling, the outer eccentric sleeve (6) is moved automatically to a different position where the load is decreased to the prescribed load Po.

The constant pressure type setting device (13-*a*) may be a hydraulic cylinder, or others, and the prescribed load Po is maintained by controlling the pressure of the hydraulic cylinder.

(14-*a*) represents the constant pressure type setting device for the inner eccentric sleeve (5) and has the same structure as that for the outer eccentric sleeve (13-*a*).

FIG. 6 shows an example of the constant pressure type setting device in which (13-*a*) and (14-*a*) operate independently of each other, but the constant pressure type setting device (13-*a*) and (14-*a*) may be constructed as a single device using a mechanism, such as a lever arm, pinion gear or others, which sets simultaneously the inner and the outer eccentric sleeves (5), (6).

By setting the inner and the outer eccentric sleeves (5), (6) by the constant pressure type setting device, the inner and the outer eccentric sleeves (5), (6) are moved when a thicker part of a web portion passes through the gap of the web guide rolls (10), and a load onto the web guide rolls (10) exceeds the prescribed load Po, so that the gap between the upper and the lower web guide rolls (10) is automatically increased. Resultantly the web thickness is not excessively reduced, and troubles with the edge rolling are prevented.

In this constant pressure type setting device, the distance between the upper flange roll (8) and the lower flange roll (8) are kept the same even when the setting position of the inner and the outer eccentric sleeves may move during the edge rolling. Resultantly the flange width of the rolling material as indicated by (L-3) in FIG. 3A is always constant, and a rolled section having an accurate flange width can be produced.

This invention has been explained where this invention is applied in making H-sections, but this invention can be used as the edging rolls for use in making shaped steel shown in FIG. 7A in which the shapes of the upper-half and the lower-half are asymmetrical. In this case, the lower roll, for example, is set as shown in FIG. 2A, and the upper roll is set as shown in FIG. 2C.

By using the edging roll of this invention, a shaped steel with flanges having a width gradually changed as shown in FIG. 7B, and a shaped steel with flanges having a width changed in a stepped manner as shown in FIG. 7C can be produced by changing the positions of the inner and the outer eccentric sleeves (5), (6) continuously or discontinuously during an edge rolling operation.

BRIEF DESCRIPTION OF THE DRAWINGS

FIG. 5B being a view showing that when the eccentric sleeve is set in its maximum eccentricity transversely, the rolling position of the flange edges and the web restraining position are offset by (m) from each other, and FIGS. 5C and 5D being views of this invention having two eccentric sleeves, showing that the web restraining position can be always set at a required position;

FIG. 10A to 10B2 are views exemplifying unpreferable cases which occur in the conventional edge rolling.

BEST MODE FOR CARRYING OUT THE INVENTION

While the edging roll of this invention is edge rolling a rolling material, the sleeve mounting portion (8*b*) of the flange roll rotates along the inner periphery of the inner eccentric sleeve (5) set at a required position. The web guide roll (10) rotates along the outer periphery of the outer eccentric sleeve (6). Thus the mounting of the inner eccentric sleeve (5) on the portion (8*b*) and that of the web guide roll (10) on the outer eccentric sleeve (6) are superposed smoothly rotatable. They are made compact and smoothly rotatable by providing the inside periphery of the inner eccentric sleeve (5) and the outer periphery of the outer eccentric sleeve (6) with bearing rings or liners having a function of a bearing.

Figure 1:
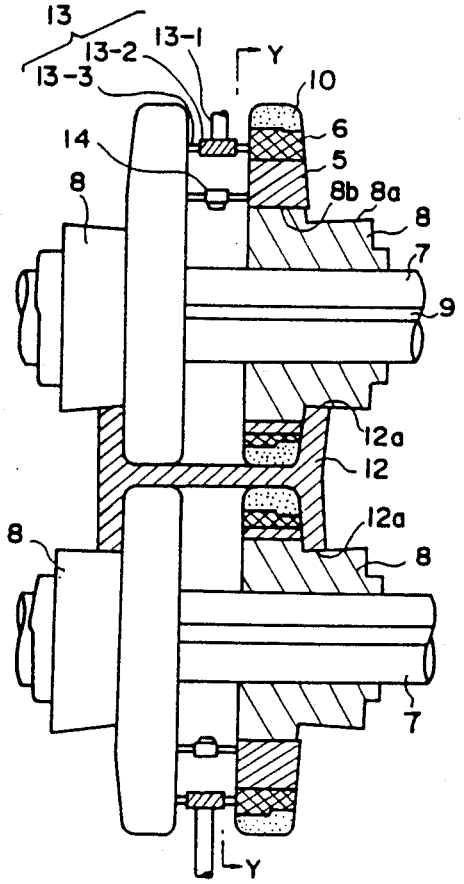
FIG. 1 is a view exemplifying the edging roll according to this invention.
Figure 1A:
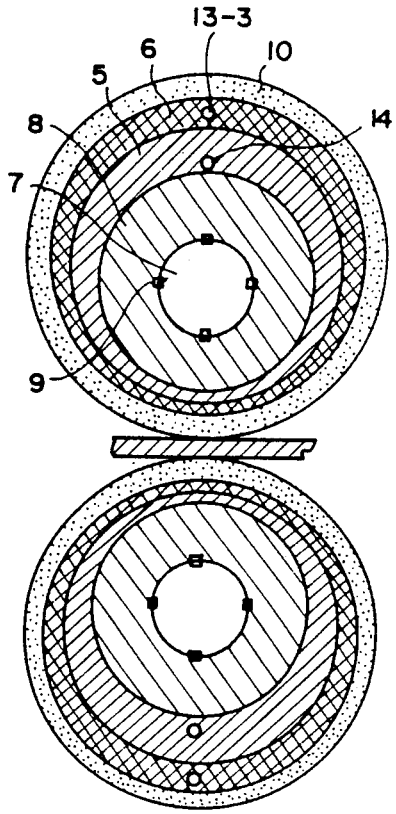
Figure 2C:
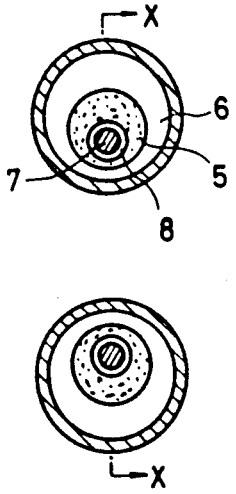
FIGS. 2A to 2C are views exemplifying the typical positions of the flange rolls (8), and the inner and the outer eccentric sleeves (5), (6), FIG. 2A showing an example in which the flange width of a rolling material is maximum, FIG. 2B showing an example in which the inner eccentric sleeve is at another position, and FIG. 2C showing an example in which the flange width of the rolling material is minimum.
Figure 2B:
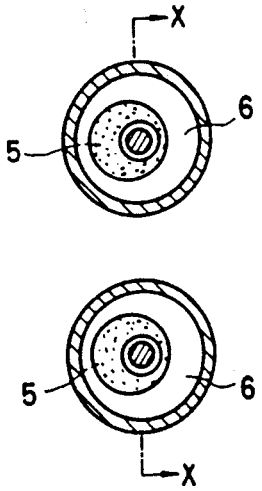
Figure 2A:
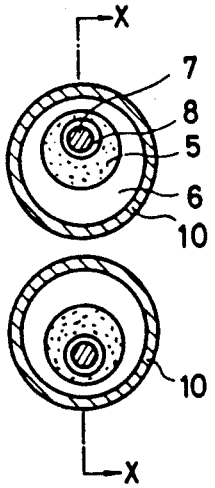

FIG. 2A shows a case where (5) and (6) are set at a position where the width (L-1) is maximum. At this time, L1(max.)=[maximum thickness of (5)]+[maximum thickness of (6)]+[thickness of (10)].

It is when the inner and the outer eccentric sleeves are set as in FIG. 2C that the width (L-1) is minimum. At this time, L1(min.)=[minimum thickness of (5)]+[minimum thickness of (6)]+[thickness of (10)].

Thus, the edging roll of this invention is adaptable to rolling material having a width (L-1) within the range of L1(max.) to L1(min.).

Figure 8:
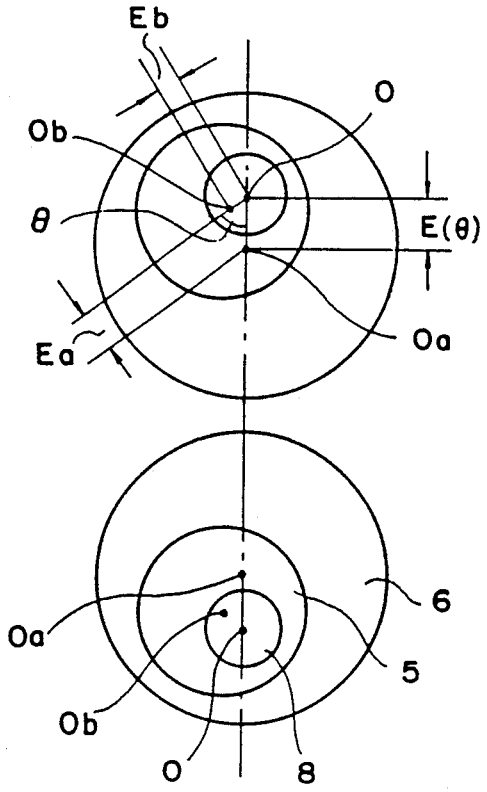
FIG. 8 is a view explaining the operation of this invention.
Figure 9:
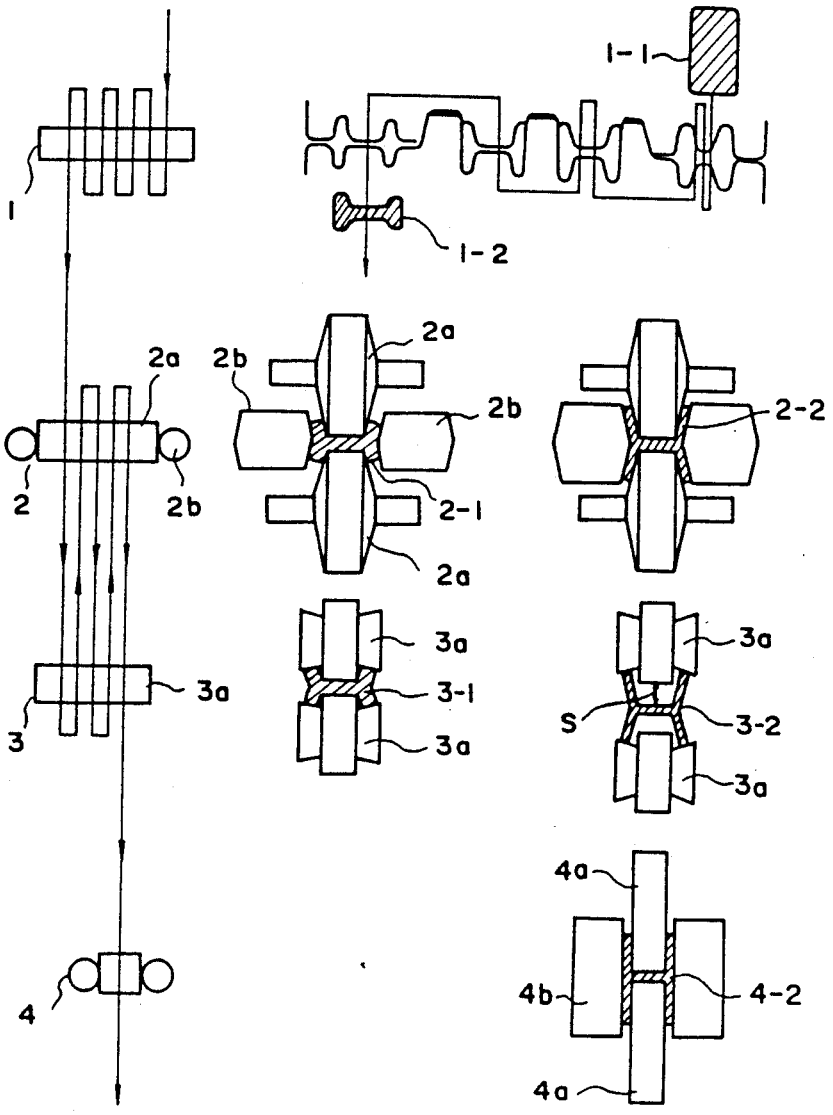
FIG. 9 is a view exemplifying the usual universal rolling method.
Figure 10A:
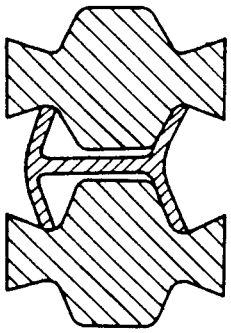
Figure 10A:
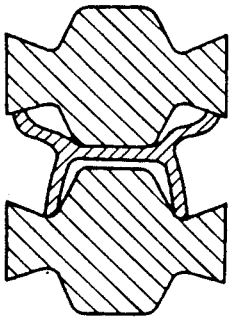
Figure 10C:
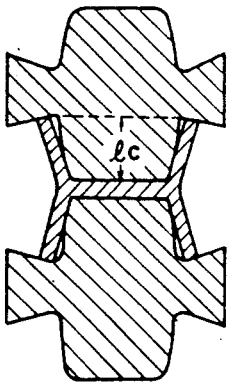
FIG. 10C is a view exemplifying the edging roll where lc is fixed.
Figure 10C:
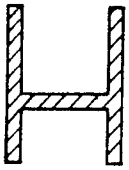

Next, the case of FIG. 2B will be explained. In FIG. 8, (O) represents the center of the flange roll (8), (O*a*) denotes the center of the outer circumference of the outer eccentric sleeve (6), and the (O*b*) is the center of the outer circumference of the inner eccentric sleeve (5). As described above, it is preferable that the position where the web guide roll (10) restrains and guides the web portion is near the line interconnecting the axial centers, i.e., line (O—O). Thus preferably the center of (O*a*) is near the line (O—O), e.g., on the line (O—O). The case in which (O*b*) is displaced by a degree ($\theta$) will be explained. At this time, $$E(\theta) = Eb \cos\theta \pm \sqrt{Ea^2 - (Eb \sin\theta)^2}$$

In this expression Ea is an amount of the eccentricity of (6) to (5), Eb is an amount of the eccentricity of (5) to (8). These amounts depend only on the shapes of (8), and (5) and (6).

Emax, which is the distance between (O) and (O*a*) in case of L1(max.), is expressed as follows.

$$E\max = Ea + Eb.$$

As mentioned above, E($\theta$) is the distance between (O) and (O*a*) in case of displacing (O*b*) by an angle $\theta$. L1($\theta$), which is the distance of (L-1) in case of displacing (O*b*) by an angle $\theta$ is expressed as follows;

$$L1(\theta) = L1(\max.) - \{E(\max.) - E(\theta)\}.$$

L1($\theta$) is expressed by a function of the angle ($\theta$), and thus (L−1) is set as required by adjusting the angle $\theta$.

INDUSTRIAL APPLICABILITY

This invention permits rolling of flange edges always guided with the web portion on various rolling materials having different flange widths and web thicknesses using the single unit of edging rolls.

Figure 3C:
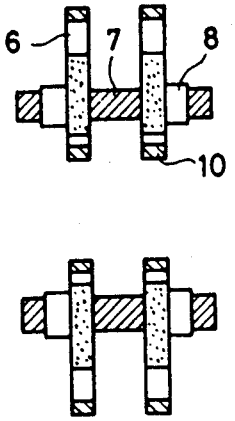
FIG. 3C is a sectional view along X—X in FIG. 2C.
Figure 3B:
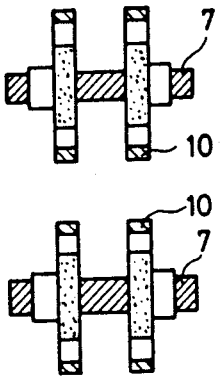
FIG. 3B is a sectional view along X—X in FIG. 2B.
Figure 3A:
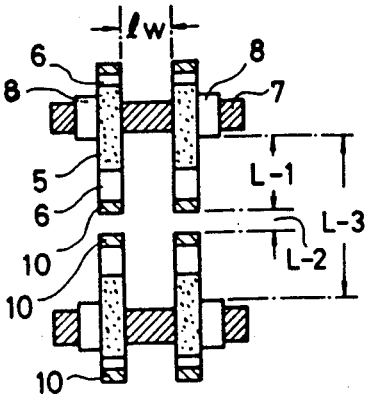
FIG. 3A is a sectional view along X—X in FIG. 2A.
Figure 4C:
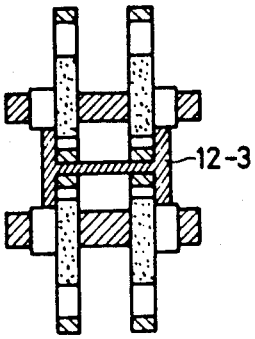
FIG. 4C is a view showing the rolling material (12-3) being edge rolled by the edging roll set in FIG. 2C.
Figure 4B:
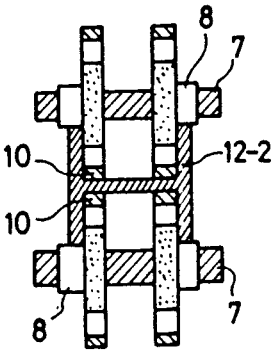
FIG. 4B is a view showing the rolling material (12-2) being edge rolled by the edging rolls set in FIG. 2B.
Figure 4A:
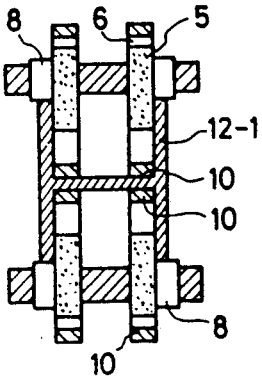
FIG. 4A is a view showing the rolling material (12-1) being edge rolled by the edging rolls set in FIG. 2A.
Figure 5A:
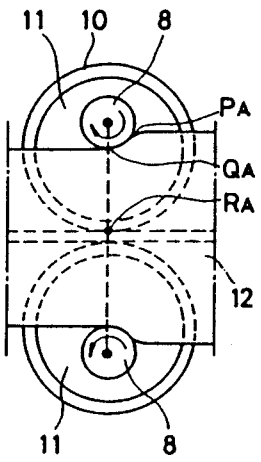
FIGS. 5A to 5D are views showing operations of the eccentric sleeves, FIGS. 5A and 5B being a reference which contains a single eccentric sleeve.
Figure 5B:
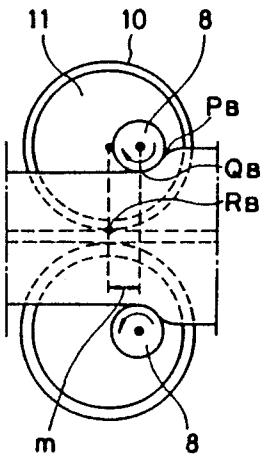
Figure 5C:
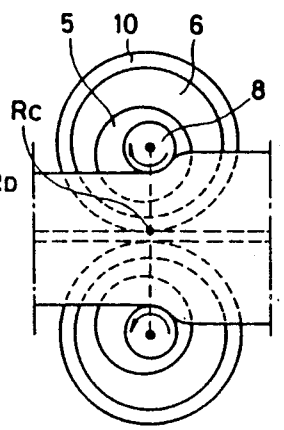
Figure 5D:
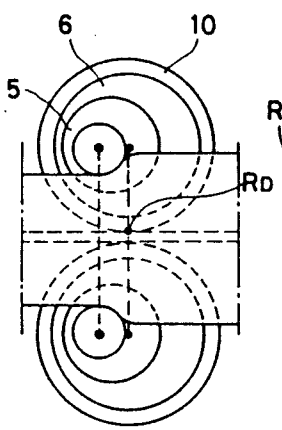
Figure 6:
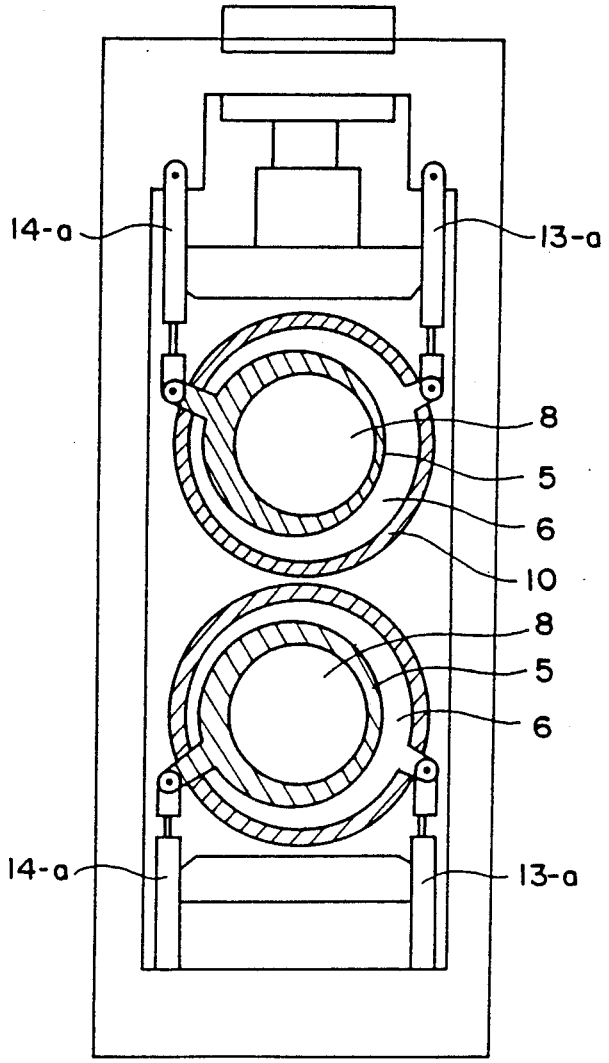
FIG. 6 is a view exemplifying the constant pressure type setting device used in this invention.
Figure 7A:
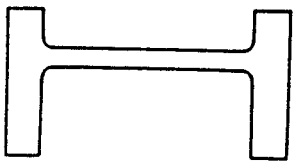
FIGS. 7A to 7C are views exemplifying sections other than the H-sections which are produced by using this invention.
Figure 7B:
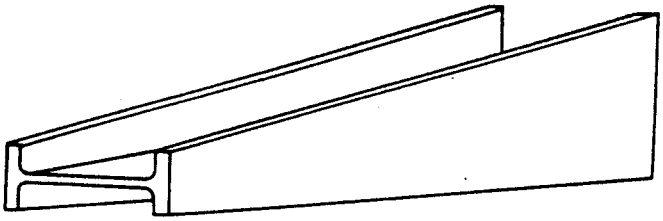
Figure 7C:
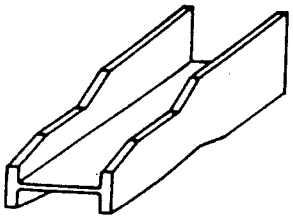

This invention enables the flange width (L-1) in FIG. 3A to be adjusted to have a required one. This results in that the dimension of the flange width (L-1) of a rolling material has high precision, that the flange edges are sufficiently forged, that a rolled section has no web-off-center, and that the flanges of a rolled section rarely buckle or sweep during edge rolling.

This web guide roll (10) of this invention is rotatable and does not hinder the run of a rolling material. This greatly improves troubles resulting from the difference of the peripheral speed of the edging roll at the flange edges and at the web portion, which take place in the conventional edging roll. Thus this invention eliminates uneven abrasion of rolls, scabby surfaces of the product. In this invention the position where the web portion is restrained and guided can be set near the line interconnecting the axial centers of the top and the bottom flange rolls (8). This ensures good edging and smooth passes of the rolling material.

The constant pressure type setting device contained in this invention prevents the excessive reduction of the web thickness of a rolling material. This prevents rolling troubles, and accurate flange width (L-3) of a product is always obtained.

I claim:

1. An edging roll for use in making shaped steel having flanges, characterized in that flange rolls (8) each having a flange rolling portion (8*a*) and a sleeve mounting portion (8*b*) are disposed right and left on a main shaft (7) rotatably together therewith, an inner eccentric sleeve (5) is disposed on the outer periphery of the sleeve mounting portion (8*b*) capable of rotating and setting at a required position thereon, an outer eccentric sleeve (6) is on the outer periphery of the inner eccentric sleeve (5) capable of rotating and setting at a required position thereon, and a web guide roll (10) is on the outer periphery of the outer eccentric sleeve (6) rotatably therealong.

2. An edging roll for use in making shaped steel having flanges according to claim 1, wherein the flange rolls (8) rotatable together with the main shaft (7) is slidable axially on the main shaft (7) and are capable of being set at a required positions on the main shaft (7).

3. An edging roll for use in making shaped steel having flanges according to claim 1, wherein an inner sleeve setting device (14) for setting the inner eccentric sleeve (5) at a required position of the sleeve mounting portion (8*b*), and an outer sleeve setting device (13) for setting the outer eccentric sleeve (6) at a required position of the inner eccentric sleeve (5) are sleeve setting device having constant pressure mechanisms.

4. An edging roll for use in making shaped steel having flanges according to claim 2, wherein an inner sleeve setting device for setting the inner eccentric sleeve at a required position of the sleeve mounting portion, and an outer sleeve setting device for setting the outer eccentric sleeve at a required position of the inner eccentric sleeve are sleeve setting device having constant pressure mechanisms.

* * * * *